US005264821A

United States Patent [19]

Vultaggio et al.

[11] Patent Number: 5,264,821

[45] Date of Patent: Nov. 23, 1993

[54] ROTARY, PUSH-PULL HEADLIGHT SWITCH WITH CERAMIC COATED METAL SUBSTRATE RHEOSTAT AND CAM ACTUATED DOME LIGHT BYPASS SWITCH

[75] Inventors: Anthony Vultaggio, Warren; Nick Smith, Southfield; David A. Coffin, Novi, all of Mich.

[73] Assignee: United Technologies Automotive, Dearborn, Mich.

[21] Appl. No.: 701,422

[22] Filed: May 15, 1991

Related U.S. Application Data

[63] Continuation-in-part of Ser. No. 618,770, Nov. 27, 1990, Pat. No. 5,140,111.

[51] Int. Cl.[5] ..... H01C 10/36

[52] U.S. Cl. ..... 338/172; 338/173; 338/198; 338/200; 200/4; 200/6 BB

[58] Field of Search ..... 338/172, 173, 174, 198, 338/200; 200/4, 6 BB, 6 BA, 6 B, 17 R, 18

[56] References Cited

U.S. PATENT DOCUMENTS

| | | | |
|---|---|---|---|
| 3,602,868 | 8/1971 | Lybrook | 338/172 X |
| 3,838,071 | 9/1974 | Amin | 252/514 |
| 4,164,633 | 8/1979 | Sheridan et al. | 200/4 |
| 4,682,142 | 7/1987 | Lohner et al. | 338/172 |
| 4,698,552 | 10/1987 | Minami et al. | 338/174 X |
| 4,827,241 | 5/1989 | Riser et al. | 338/172 |
| 4,885,434 | 12/1989 | Vultaggio et al. | 200/4 |

OTHER PUBLICATIONS

Schabacker "The Porcelain Enameled Metal Substrate and its Application for Electronic Circuitry," FERRO-ECA Electronics Company Technical Report, pp. 4-6 (publication date unknown) Author Robert B. Schabacker.

*Primary Examiner*—Marvin M. Lateef

*Attorney, Agent, or Firm*—George J. Romanik; Jodi Ann Medeiros

[57] ABSTRACT

A rotary, push-pull switch (20) for use in an automobile has a rotating ceramic coated metal substrate rheostat (48) and a supplemental switch (52) which opens and closes a dome light bypass circuit. The supplemental switch (52) is mounted internally to the rotary, push-pull switch (20) adjacent to the rotating rheostat (48) disposed on a shaft (36). A projection (88), which is radially disposed on the shaft (36), is used to actuate the supplemental switch (52) by engaging a resilient contact leaf (60) when the shaft (36) is rotated sufficiently. The engagement of the projection (88) and contact arm (60) causes the separation of a contact (62) and terminal (64), opens the dome light bypass circuit, and precludes energizing the dome light.

19 Claims, 5 Drawing Sheets

ROTARY, PUSH-PULL HEADLIGHT SWITCH WITH CERAMIC COATED METAL SUBSTRATE RHEOSTAT AND CAM ACTUATED DOME LIGHT BYPASS SWITCH

This application is a continuation-in-part of commonly assigned, copending U.S. Ser. No. 07/618,770, filed Nov. 27, 1990, now U.S. Pat. No. 5,140,111 issued Aug. 18, 1992 entitled "Cam Actuated Dome Light Bypass Switch."

TECHNICAL FIELD

The present invention relates to automotive electrical switches and more particularly to rotary, push-pull combination headlight switches.

BACKGROUND ART

Rotary, push-pull combination switches have received widespread use within the automobile industry. Typically, the push-pull action of the switch operates the headlights, while the rotary action operates a dimmer switch which uses a rheostat to control the intensity of the instrument panel lights. The rotary action can also be used to control supplemental electrical circuits such as a dome light bypass switch which prevents door switches from energizing the dome light.

Combination automobile headlight switches are subject to several general design limitations. First, the switches should be compact to fit in the confined space allocated to them. Second, the switches should be uniform in size and design in order to fit within a wide variety of automobiles. Finally, the switches should be easy to fabricate at a low cost. The dimmer switch used to control instrument panel light intensity is subject to the additional limitation that it be capable of handling currents of up to 5 amps.

Typically, the dimmer switch portion of a combination headlight switch incorporates a rotatable, cemented resistor wire rheostat. Such a combination switch is disclosed in commonly assigned U.S. Pat. No. 4,827,241 to Riser et al. Cemented resistor wire rheostats comprise coils of resistor wire cemented together and a contactor which moves along the coils to vary the resistance of the rheostat. While cemented resistor wire rheostats are capable of reliable operation, they have several drawbacks. For example, their operational feel and sound quality can be affected by the assembly process or by the need to vary the number of coils and resistor wire diameter to provide the resistance required in a particular application. In addition, the number of components used to make the rheostats and the relatively wide dimensional tolerances of each part can lead to tolerance stack up when the switches are assembled. Moreover, the cemented wires in the rheostats are subject to breakage during assembly, leading to potential quality or reliability problems. Finally, the rheostats are subject to operational runout or wobble, which can lead to problems with operational stability. Other types of rheostats, including stationary, flat rheostat panels attached to heat sinks, are generally known. Commonly assigned U.S. Pat. No. 4,885,434 to Vultaggio et al. proposed the use of stationary flat panel rheostats in automotive headlight switches.

Combination switches used as headlight switches may also have a supplemental switch to control the dome light bypass circuit. One such switch uses a rotating rheostat with a projection which engages a dome light bypass switch externally mounted on the side of the headlight switch housing. The dome light bypass switch consists of an exposed arm extending longitudinally up the side and parallel to the shaft. This switch, however, may be too large for many applications, is susceptible to damage due to exposure of the external arm, and to tolerance stack up during fabrication.

U.S. Pat. No. 4,885,434 discloses a headlight switch with rotating arms mounted on the shaft and a stationary rheostat. A dome light bypass switch is internal to the headlight switch housing and functions by having one of the rotating arms engage a plunger which pushes open the dome light bypass switch. The plunger and dome light bypass switch are disposed on the stationary rheostat. Although this headlight switch solves the problems related to the size of such switches, it is difficult to fabricate due to the use of several leaf-type contacts which require extraordinary care during fabrication in order to prevent damage.

U.S. Pat. No. 4,827,241 suggests an alternative solution which uses a projection on a driver assembly to engage a dome light bypass switch which is sandwiched in line with the rotating components. As with the headlight switch disclosed in U.S. Pat. No. 4,885,434, the dome light bypass switch is internal to the headlight switch housing, which results in a compact switch. In addition, this headlight switch is very forgiving to tolerance stack up during fabrication. Unfortunately, the rotational components have to be small due to the sandwich arrangement and this leads to an overheating problem which limits the switch to low current applications (less than 5 Amp). The low current limitation makes this switch inadequate for the desired automotive use.

DISCLOSURE OF INVENTION

One object of the invention is to include a ceramic coated metal substrate rheostat capable of handling up to about 5 amps in an improved automobile instrument panel light dimmer switch.

Another object of the invention is to include the improved automobile instrument panel light dimmer switch in a rotary, push-pull combination switch.

Another object is to include an improved supplemental switch on a rotary, push-pull headlight switch.

Another object is to include an improved dome light bypass switch on a rotary, push-pull headlight switch.

According to the invention, an automobile instrument panel dimmer switch includes a ceramic coated metal substrate rheostat. Further, a rotary, push-pull combination switch includes an instrument panel dimmer switch having a ceramic coated metal substrate rheostat on a shaft. Rotation of the shaft causes a projection, radially disposed on the shaft, to engage a resilient contact leaf, disposed on the frame and adjacent to the shaft and rotating components, causing separation of a contact point and terminal and thereby opening a supplemental circuit. In this way the rotary, push-pull headlight switch remains compact and externally uniform. The mounting of the supplemental switch internally and directly to the frame protects it and minimizes the risk of tolerance accumulation during fabrication. Further, the supplemental switch is used as a dome light bypass switch to open and close a dome light bypass circuit. Since the dome light bypass switch is mounted adjacent to the shaft and rotating components, rather than in line with them, there is sufficient space in the forward bracket area to allow for proper sizing of the components for use of the dome light bypass switch in the electrical current ranges desired.

The foregoing and other objects, features, and advantages of the present invention will become more apparent in light of the following detailed description of exemplary embodiments thereof, as illustrated in the accompanying drawings.

BEST MODE FOR CARRYING OUT THE INVENTION

Figure 1:
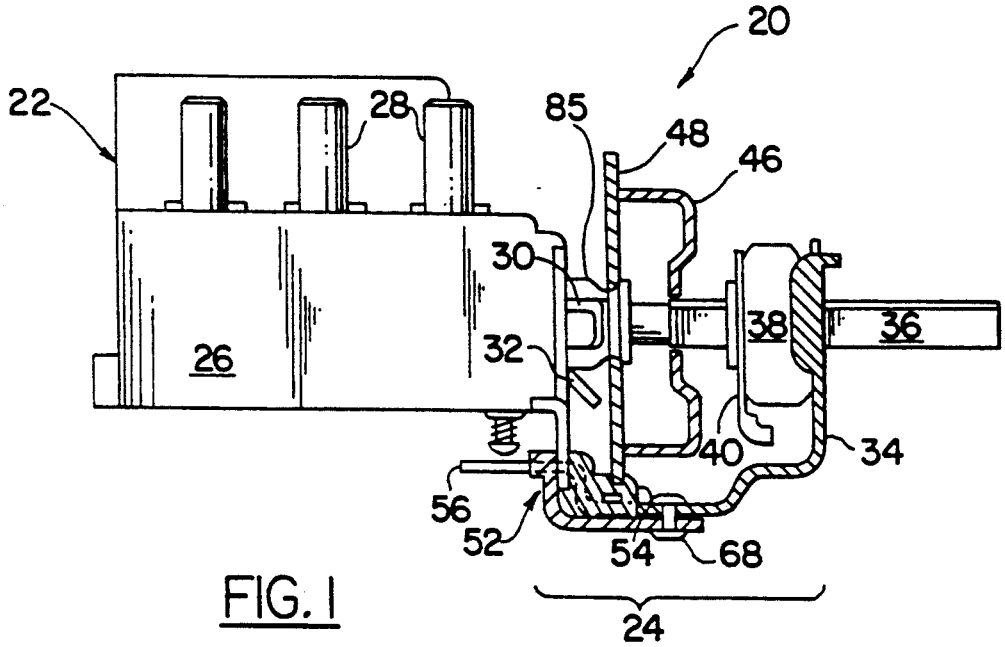
FIGS. 1 and 2 are partially sectioned side and top views, respectively, of a rotary, push-pull headlight switch.
Figure 2:
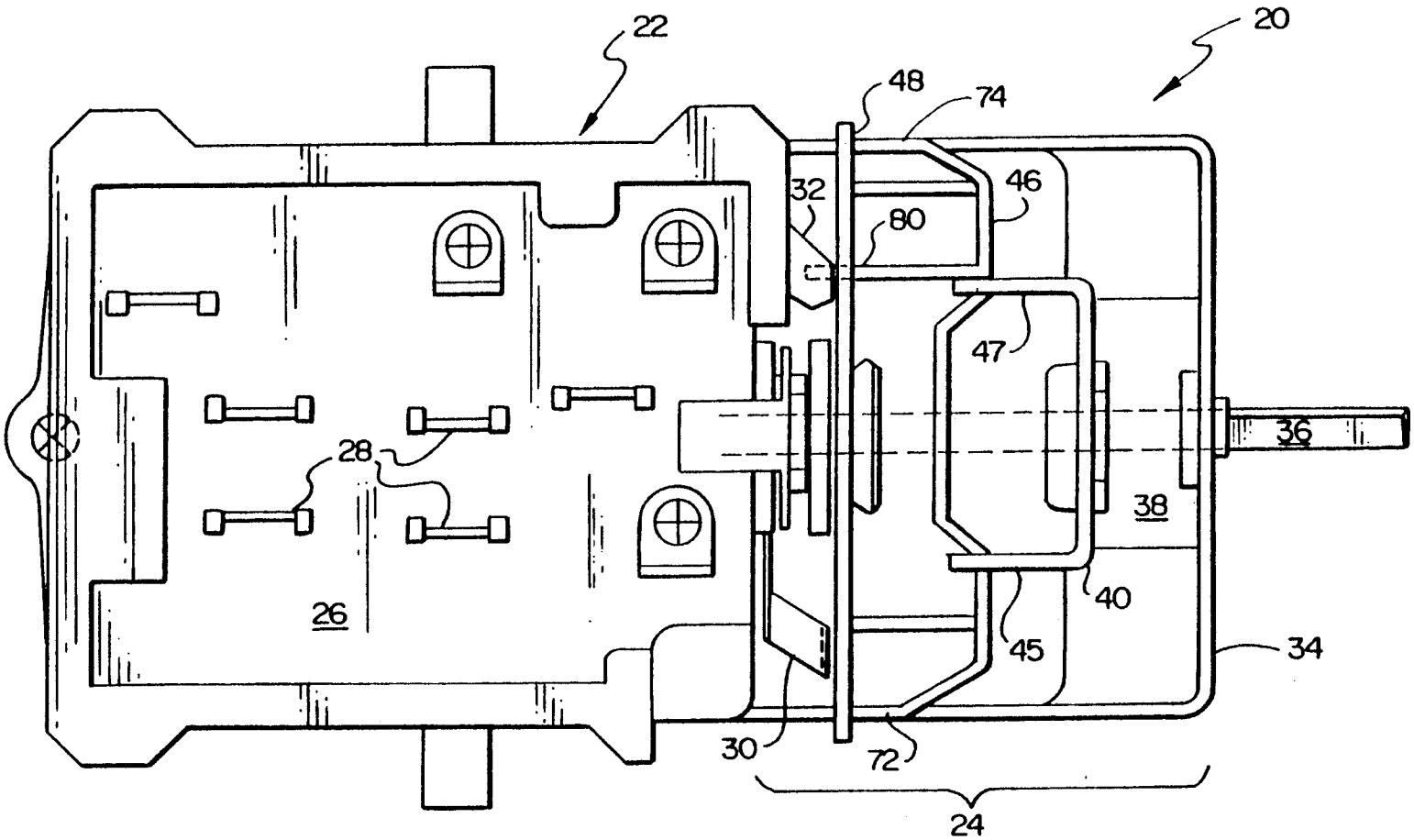

FIGS. 1 and 2 show a headlight switch assembly 20 which consists of an electrical switch component 22, which is unchanged from prior art, and a front bracket assembly 24. The electrical switch component 22 consists of a switch body 26, internal circuitry (not shown), a plurality of terminal pins 28, an instrument light wiper 30 extending forward from the body 26, and a dome light on/off leaf 32 extending forward from the body 26.

The front bracket assembly 24 consists of a frame 34, designed to mount onto an automotive instrument panel (not shown), a shaft 36 extending through the frame 34 and into the body 26 of the electrical switch component 22, a stationary spacer 38, a driver 40 which is slip fit on and engaged by the shaft 36, a rotary spacer 46 engaged by the driver 40, a rheostat 48 which is slip fit on the shaft 36 and engaged by the rotary spacer 46, and a dome light bypass switch assembly 52.

The shaft 36 is permitted both rotational motion about and axial movement along its longitudinal axis. The rotational movement engages the components of the front bracket assembly 24 and the axial movement engages a headlight switch (not shown) located inside the electrical switch component 22.

Figure 3:
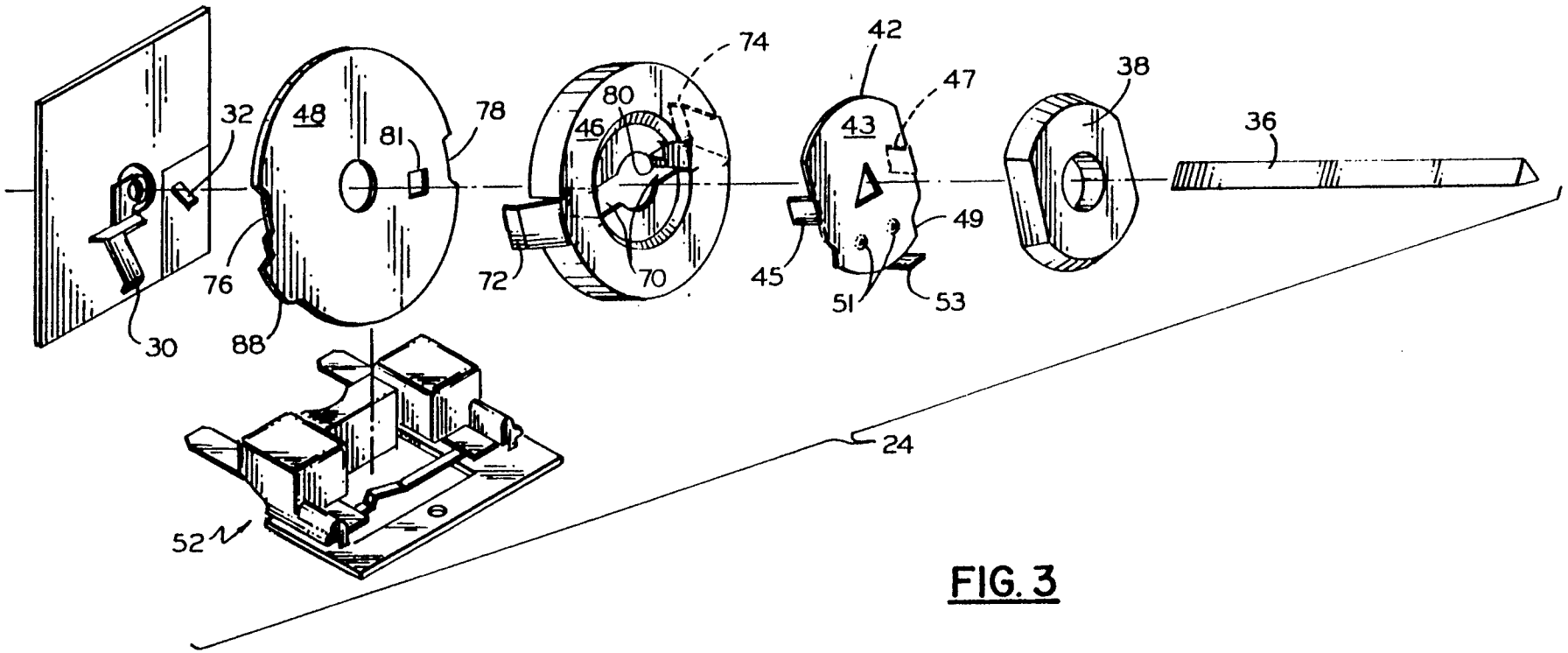
FIG. 3 is a front perspective exploded view of the forward components of a rotary push-pull headlight switch.

The interaction of the principal components of the front bracket assembly 24 is more clearly shown in FIG. 3. The driver 40 consists of a base plate 43, two back projections 45, 47, and a wing 49 with a plurality of dimples 51 and a forward projection 53. The dimples 51 interact with the stationary spacer 38 to provide detent positions for the various rotational functions and the forward projection 53 engages the stationary spacer 38 to provide rotational stop positions for the headlight switch assembly 20. The back projections 45, 47 engage the rotary spacer 46 through ends of a cut-out 70 in order to translate the rotational driving force from the shaft 36 to the rotary spacer 46. The rotary spacer 46 engages a rheostat 48 by two short protrusions 72, 74 which fit within cutouts 76, 78 around the edge of the rheostat 48 and by a long protrusion 80 on the rotary spacer 46 which extends through a hole 81 in the rheostat 48 and engages the dome light on/off leaf 32 upon sufficient rotation of the shaft 36. A cam 88 is disposed on the edge of the rheostat 48 and, upon sufficient rotation of the shaft 36, engages the dome light bypass switch assembly 52.

Figure 4:
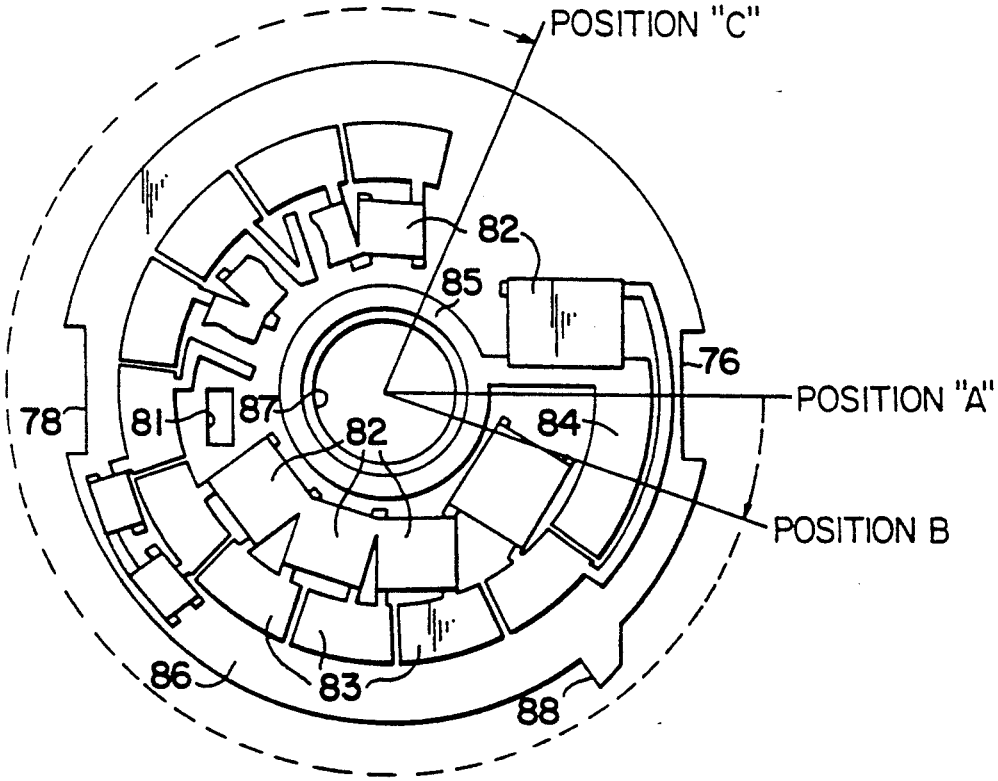
FIG. 4 is a rear view of a ceramic coated metal substrate rheostat with switch positions superimposed upon it.

The rheostat 48, as viewed from the rear in FIG. 4, consists of a ceramic coated metal substrate base plate 86 and a resistor circuit having a plurality of conductor pads 83, including a zero resistance pad 84, disposed on the base plate 86 and a plurality of resistor surfaces 82 disposed over the pads 83, 84 to connect the pads in series. A conductive bushing 85 extends through a hole 87 in the baseplate 86 to establish electrical contact between the zero resistance pad 84 and the electrical switch component 22.

The ceramic coated metal substrate baseplate 86 comprises a metal substrate which is completely encased within a thin, electrically insulating, thermally conductive ceramic coating. The metal substrate may be any metal such as steel, aluminum, copper, or another metal which permits the base plate 86 to act as a heat sink to dissipate heat generated by the rheostat 48 and to be stiff enough to maintain contact with the instrument light wiper 30 throughout the entire arc of rotation. Preferably, the substrate will be made from decarburized steel having a thickness between about 0.020 inches (in) and about 0.078 in. The ceramic coating may be any electrically insulating, thermally conductive electrical grade of porcelain glass enamel. The coating should completely cover the substrate to electrically isolate both sides of the substrate and to provide complete electrical insulation which will prevent short circuits due to inadvertent contact with the various metal components and electrical circuits located behind an automobile's instrument panel. Preferably, the ceramic coating will be about 0.003 in to about 0.008 in thick and will provide a dielectric constant of greater than about 2.5 kV at 25° C., a thermal conductivity of about 0.57 Watts/centimeter/°C., and a conductor pad adhesion of greater than about 5 pounds for a 0.1 in by 0.1 in conductor pad. Such a ceramic coating is commercially available as ELPOR® II from Ferro-ECA Electronics Company (Erie, Pa.). The combination of the metal substrate and the thermally conductive ceramic coating permits the baseplate 86 to act as a heat sink, allowing the rheostat 48 to handle currents of up to about 5 amps.

The resistor surfaces 82, conductor pads 83, and zero resistance pad 84 which make up the resistor circuit may be printed onto the baseplate 86 using conventional thick film techniques. The pads 83, 84 may be of any convenient shape and size and may be arranged in any convenient pattern. For example, the pads may have roughly rectangular bodies with thin rectangular leads extending radially from the bodies towards the center of the base plate 86. Preferably, the conductor pads 83 and zero resistance pad 84 will be made from silver or a silver-glass mixture which is compatible with the ceramic coating. Such a material may be purchased from Ferro-ECA Electronics Company and other manufacturers. The resistor surfaces 82 may also be of any convenient size and shape and may be disposed over the pads 83, 84 in any convenient pattern. Preferably, the resistor surfaces 82 should be sized to handle the electrical current requirements of a particular application. For example, the resistor surfaces 82 may be sized to provide equal resistive increments between each of the pads 83, 84. Such a design will result in nonlinear dimming of the instrument panel lights because the nonlinear relationship between lamp voltage and lamp illumination will create a nonlinear relationship between rheostat rotation and lamp illumination. Alternately, the resistor surfaces 82 may be sized to produce a voltage curve that creates a linear relationship between rheostat rotation and lamp illumination to provide linear dimming of the instrument panel lights. Preferably, the resistor surfaces 82 will be made from a commercially available resistive cermet thick film paste compatible with the ceramic coating. Such a material may be purchased from Ferro-ECA Electronics Company and other manufacturers.

As the rheostat 48 is rotated, various conductor pads 83 make contact with the instrument light wiper 30 creating a conductive path of varying resistance and causing the intensity of the instrument panel lights to vary. The various switch positions, as a function of rotation, are shown as viewed from the rear of the headlight switch assembly 20. In the full counterclockwise position (Position A), from the perspective of the user, the instrument light wiper 30 encounters the zero resistance pad 84 and the long protrusion 80 engages the dome light on/off leaf 32, thereby causing the instrument panel light intensity to be maximum and the dome light to be energized. As the shaft 36 is rotated clockwise, the long protrusion 80 disengages from the dome light on/off leaf 32 (Position B), thereby causing the dome light to be de-energized, and the instrument light wiper 30 encounters increased resistance until the full clockwise position (Position C) when the instrument light wiper 30 encounters the insulating base plate 86 and the instrument panel light circuit is opened.

Figure 5:
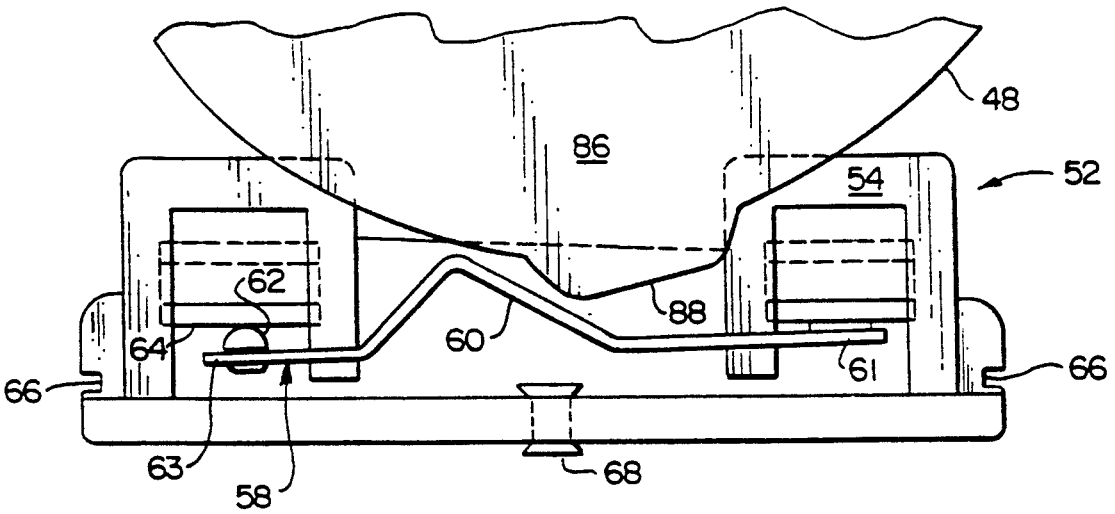
FIGS. 5, 6 and 7 are front, side and top views, respectively, of a dome light bypass switch.
Figure 6:
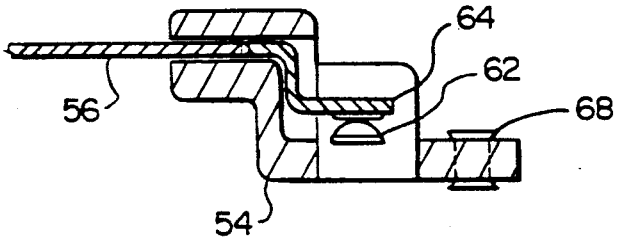
Figure 7:
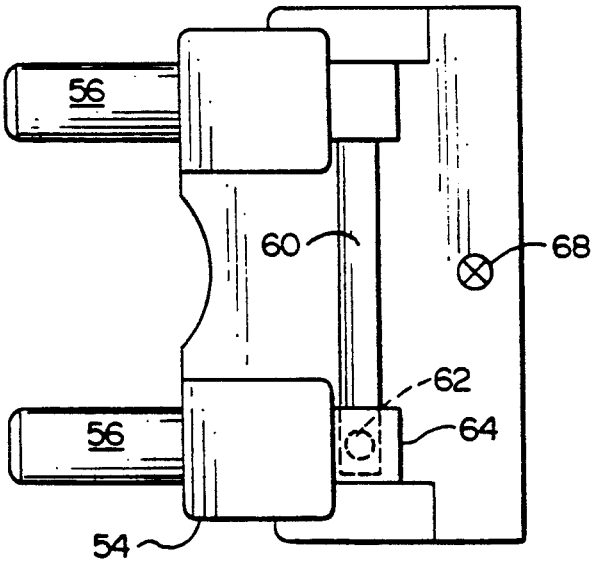

The dome light bypass switch assembly 52, shown in detail in FIGS. 5, 6, and 7, is disposed in a fixed relationship to the frame 34 directly beneath the rheostat 48 and consists of a terminal block 54, two terminal pins 56 press fit into the terminal block 54, and a contact assembly 58 which consists of a resilient contact leaf 60 with one end 61 rigidly disposed on the terminal block 54, a contact point 62 disposed on the other end 63 of the resilient contact leaf 60, and a terminal 64 disposed on the terminal block 54. The terminal block 54 is attached to the frame 34 by grooves 66 (FIG. 5) which allow the terminal block 54 to be positioned onto the frame 34 and a retaining mechanism 68, such as a rivet, which secures the terminal block 54 into position.

As shown in FIG. 5, a cam 88 on the base plate 86 of the rheostat 48 engages the resilient contact leaf 60 and causes separation of the contact point 62 and terminal 64 in the dome light bypass switch assembly 58 when the shaft 36 is completely rotated in the clockwise direction (Position C in FIG. 4). The separation of the contact point 62 and terminal 64 causes an opening of the dome light circuit and precludes the activation of the dome light. Rotation in the counter-clockwise direction disengages the cam 88 from the contact leaf 60 causing it to return to its initial position, the contact 62 and terminal 64 to reconnect, and the dome light may be energized.

Figure 8:
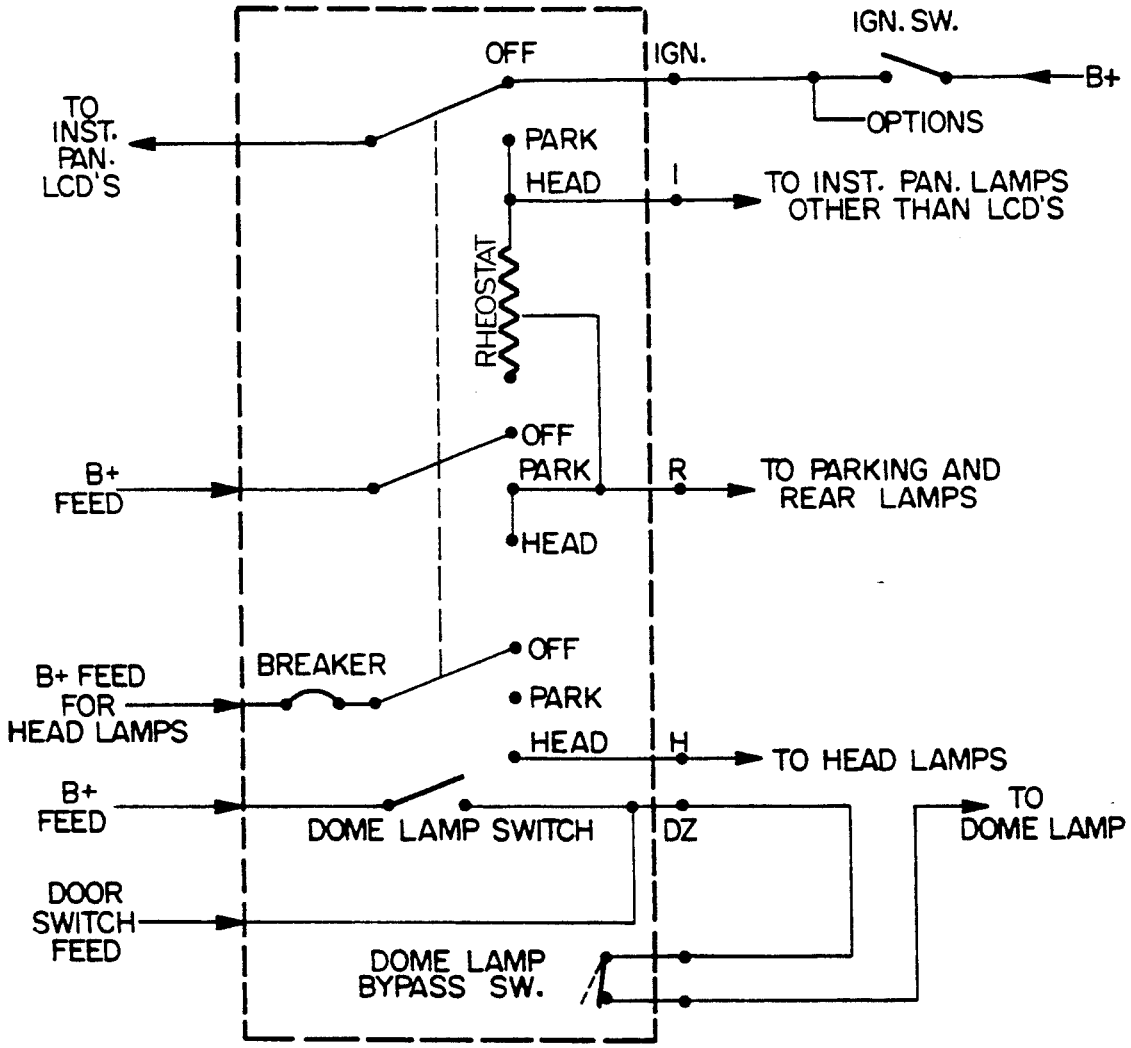
FIG. 8 is a general circuit diagram of a rotary, push-pull headlight switch system.

The opening and closing of the various circuits which control the headlights, instrument panel lights, and dome light are shown generally in the switch circuit schematic of FIG. 8. The switches controlled by the push-pull action are indicated by a dashed line and the remaining switches are controlled by the rotational action.

The present invention provides several benefits over the prior art.

First, the ceramic coated metal substrate rheostat proves a uniform operational feel and sound quality regardless of the assembly process or resistance value required in a particular application.

Second, the ceramic coating on the metal substrate produces a rheostat which is less abrasive than prior art rheostats. Therefore, the light wiper and any other parts which come in contact with the rheostat will have a longer service life.

Third, the resistive circuit on the ceramic coated metal substrate rheostat may be designed to provide linear dimming of the instrument panel lights.

Fourth, the ceramic coated metal substrate rheostat has fewer components than prior art cemented resistor wire rheostats and each of the components can be manufactured to closer tolerances. Therefore, the rheostat portion of the present invention is less sensitive to tolerance stack up than the prior art. Moreover, the supplemental switch is also less sensitive to dimensional tolerances than the prior art.

Fifth, the ceramic coated metal substrate rheostat is mechanically more rugged and less prone to breakage than the prior art cemented resistor wire rheostats. Therefore, the present invention will be more reliable and produce fewer scrap parts than the prior art.

Sixth, the ceramic coated metal substrate rheostat is less sensitive to operational runout than cemented resistor wire rheostats. Therefore, the present invention will operate with more stability than the prior art.

Seventh, the supplemental switch is compact, easy to fabricate, and not prone to overheating or damage. Therefore, the present invention has overcome many of the drawbacks of the prior art.

Although the invention has been shown and described with respect to exemplary embodiments thereof, it should be understood by those skilled in the art that various changes, omissions and additions may be made therein and thereto, without departing from the spirit and scope of the invention. For example, the rheostat described can be installed in automobile instrument panel dimmer switches which are not an integral part of a combination headlight switch. In addition, the supplemental switch feature of the present invention may be used to control other supplemental electrical circuits and components, as desired. Moreover, alternate embodiments of the invention may use a cam or other projection disposed on a rotating component other than the rheostat 48 to operate the supplemental switch.

We claim:

1. An automobile rotary, push-pull combination switch, comprising:

(a) a frame mountable on an automobile instrument panel;

(b) an electrical switch component disposed on said frame;

(c) a rotatable shaft with axial positioning capabilities disposed on said frame; and (d) a rheostat having a metal substrate baseplate encased within an electrically insulating, thermally conductive ceramic coating, said rheostat being disposed on said shaft and actuated by rotation of said shaft.

2. The switch of claim 1, wherein said rheostat further comprises:

a) a resistor circuit having a plurality of discrete conductor pads, including a zero resistance pad, disposed on said ceramic coated metal substrate baseplate; and b) a plurality of discrete resistive surfaces disposed over portions of said conductor pads such that said conductor pads are connected in series.

3. The switch of claim 2 wherein said conductor pads are silver or a silver-glass material compatible with said ceramic coated metal baseplate.

4. The switch of claim 2 wherein said resistive surfaces are a resistive cermet.

5. The switch of claim 2 wherein said resistive surfaces are sized to produce a voltage curve that creates a linear relationship between rheostat rotation and lamp illumination to provide linear dimming of instrument panel lights.

6. The switch of claim 1, further comprising:

(e) a projection disposed in a radially fixed relationship with said shaft; and (f) a supplemental switch, which is disposed within said frame and adjacent to said shaft, actuated by said projection upon sufficient rotation of said shaft.

7. The switch of claim 6, wherein said supplemental switch comprises:

(a) a terminal block;

(b) a pair of terminals disposed on said terminal block; and (c) a resilient contact leaf having a first end electrically connected to one of said pair of terminals, with a second end initially positioned to make electrical contact with the other of said pair of terminals, and shaped to engage with said projection upon sufficient rotation of said shaft, whereby said engagement causes a separation of said second end and said other of said pair of terminals.

8. The switch of claim 6, wherein said projection is disposed in a fixed relationship with said rheostat and said rheostat is disposed in a radially fixed relationship with said shaft.

9. The switch of claim 6, wherein said supplemental switch is a dome light bypass switch.

10. The switch of claim 9, wherein said dome light bypass switch comprises:

(a) a terminal block;

(b) a pair of terminals disposed on said terminal block; and (c) a resilient contact leaf having a first end electrically connected to one of said pair of terminals, with a second end initially positioned to make electrical contact with the other of said pair of terminals, and shaped to engage with said projection upon sufficient rotation of said shaft, whereby said engagement causes a separation of said second end and said other of said pair of terminals.

11. The switch of claim 9 wherein said projection is disposed in a fixed relationship with said rheostat and said rheostat is disposed in a radially fixed relationship with said shaft.

12. The switch of claim 2 wherein said resistive surfaces are sized to provide equal resistive increments between each of said discrete conductor pads in order to produce nonlinear dimming of instrument panel lights.

13. An automobile rotary, push-pull combination switch, comprising:

(a) a frame mountable on an automobile instrument panel;

(b) a rotatable, longitudinally extending shaft with axial positioning capabilities disposed on said frame;

(c) an electrical switch component disposed on said frame and engaged with said shaft;

(d) a rheostat having a metal substrate baseplate encased within an electrically insulating, thermally conductive ceramic coating, said rheostat being disposed on said shaft and actuated by rotation of said shaft;

(e) a projection disposed in a radially fixed relationship with said shaft;

(f) a supplemental switch, which is disposed within said frame and adjacent to said shaft, actuated by said projection upon sufficient rotation of said shaft, wherein said supplemental switch includes:

(i) a terminal block;

(ii) a pair of terminals disposed on said terminal block; and (iii) a resilient contact leaf having a first and electrically connected to one of said pair of terminals, with a second end initially positioned to make electrical contact with the other of said pair of terminals, and shaped to engage with said projection upon sufficient rotation of said shaft, whereby said engagement causes a separation of said second end and said other of said pair of terminals.

14. The switch of claim 13, wherein said supplemental switch is a dome light bypass switch.

15. The switch of claim 13, wherein said rheostat further comprises:

(a) a resistor circuit having a plurality of discrete conductor pads, including a zero resistance pad, disposed on said ceramic coated metal substrate baseplate; and (b) a plurality of discrete resistive surfaces disposed over portions of said conductor pads such that said conductor pads are connected in series.

16. The switch of claim 15 wherein said conductor pads are silver or a silver-glass material compatible with said ceramic coated metal baseplate.

17. The switch of claim 15 wherein said resistive surfaces are a resistive cermet.

18. The switch of claim 15 wherein said resistive surfaces are sized to produce a voltage curve that creates a linear relationship between rheostat rotation and lamp illumination to provide linear dimming of instrument panel lights.

19. The switch of claim 15 wherein said resistive surfaces are sized to provide equal resistive increments between each of said discrete conductor pads in order to produce nonlinear dimming of instrument panel lights.

* * * * *